US005848902A

United States Patent [19]

Yamaguchi et al.

[11] Patent Number: 5,848,902

[45] Date of Patent: Dec. 15, 1998

[54] CONNECTOR DEVICE

[75] Inventors: Atsuyoshi Yamaguchi; Minoru Kubota, both of Shizuoka, Japan

[73] Assignee: Yazaki Corporation, Tokyo, Japan

[21] Appl. No.: 880,394

[22] Filed: Jun. 23, 1997

[30] Foreign Application Priority Data

Jun. 24, 1996 [JP] Japan ..... 8-163443

[51] Int. Cl.[6] ..... H01R 13/62

[52] U.S. Cl. ..... 439/34; 439/342

[58] Field of Search ..... 439/545, 34, 342, 439/343, 341

[56] References Cited

U.S. PATENT DOCUMENTS

| | | | |
|---|---|---|---|
| 1,835,109 | 12/1931 | Ayres | 439/341 |
| 4,659,168 | 4/1987 | Collier | 439/341 |
| 5,484,186 | 1/1996 | Van Order et al. | 439/34 |

FOREIGN PATENT DOCUMENTS 1-307180 12/1989 Japan .

OTHER PUBLICATIONS

IBM Technical Disclosure Bulletin, "Connector for Printed Circuit", vol. 32, No. 5B, pp. 316–317. 439/545 Oct. 1989.

*Primary Examiner*—Gary F. Paumen

*Attorney, Agent, or Firm*—Armstrong, Westerman, Hattori, McLeland & Naughton

[57] ABSTRACT

A unit side connector (15) is provided on top of an electric equipment unit (C), which connector has a first connector body (16), and first and second guide flanges (24, 24'). A wait connector (26) is fixed at the ceiling section of an automobile body panel, which connector has a second connector body (27), a connector cover (30), an insertion guide groove (32), and support pieces (33). The unit side connector (15), after its first guide flange (24) is inserted into the insertion guide groove (32), is as a whole pushed against the connector cover (30), and then slid toward the second connector body (27) to cause the first and second connector bodies (16, 27) to be fitted and connected to each other and the second guide flanges (24, 24') to be supported on the support pieces (33). A connector device is provided which enables a connecting operation to be performed easily even at unfavorable positions such as at the ceiling section of an automobile cabin which requires an operator to look up during work.

5 Claims, 17 Drawing Sheets

CONNECTOR DEVICE

BACKGROUND OF THE INVENTION

1. Field of the Invention

This invention relates to a connector device suited for making a connection between an electric equipment unit installed on an automobile and a connector at an end of a wiring harness or the like.

2. Description of the Related Art

FIG. 24 shows roof-mounted components at the ceiling section of an automobile. In other words, at the ceiling section a there are mounted a multiplicity of components such as a molded ceiling b, roof wiring harness c, room lamps d, lamp covers e, not-shown rear-view mirror, sun visor, switches, magnetic sensor and the like.

The assembly of these components to an automobile body is effected by first fastening a wiring harness c to the ceiling section a with a multiplicity of clips f, assembling the molded ceiling b, fixing components such as the room lamps d, their switches, the rear-view mirror and the like through the molded ceiling b to the automobile body with screws and the like. At this time, connectors g at ends of the wiring harness c are pulled out of molded ceiling holes b1 and connected to those electric components which requireconnection with the wiring harness c, for example, to the connectors d1 of the room lamps d.

The electric wiring and component-mounting operations as mentioned above require an operator to enter the confined automobile cabin and do the working always in a looking up position, causing much fatigue and disabling him from continuing the work for a long period of time.

Thus, as a means to simplify the work, reduce fatigue and attain an improved productivity, a connector device as shown in FIG. 25 has been proposed in Japanese Patent Application Laid-Open Specification No. 1-307108, which consists of a molded plate h and circuit bodies i incorporated therein. With this connector device, however, although an elimination can be made of the wiring operation of a wiring harness, connecting operations still remain to be performed for connecting a multiplicity of its connectors to other electric components. Further, an operator must still perform these connecting operations in a looking up position as in the connecting of the connectors g to the connectors d1, resulting in possible damages to connectors due to an undue force produced during the operator's working in the awkward looking up position, and rendering the device unsuited for use with multipolar connectors which require a large fitting force.

SUMMARY OF THE INVENTION

This invention has been accomplished to overcome the above drawbacks and an object of this invention is provide a connector device which enables connecting operations to be easily performed without applying an undue external force even at unfavorable positions such as at the ceiling section of an automobile cabin which require an operator to look up, and which is suitable for use with multipolar connectors.

In order to attain the object, according to this invention, there is provided a connector device which comprises: a unit side connector provided on a surface of an electric equipment unit, the unit side connector comprising a connector support, a first connector body accommodating at least one terminal therein and provided at one end of the connector support, and a first guide flange provided projecting on an end surface of the other end of the connector support and second guide flanges provided projecting at lateral end surfaces of the connector support; and a wait connector fastened to a wall surface as of an automobile body panel, the wait connector comprising a connector cover, a second connector body accommodating therein at least one mating terminal for the first-mentioned terminal and provided at. one end of the connector cover, an opening formed at the other end side of the connector cover, adjacent to the second connector body for accommodation therein of the unit side connector, an insertion guide groove formed at one end of the opening at the other end side of the connector cover, and support pieces provided projecting inwardly at lateral opposte sides of the opening, wherein the unit side connector, after the first guide flange thereof is inserted into the insertion guide groove, is as a whole moved into the opening and pushed against a ceiling wall thereof, and then slid toward the second connector body to cause the first and second connector bodies to be fitted and connected to each other and the second guide flanges to be supported on the support pieces.

With the construction as mentioned above, if the wait connector is provided fixed, for example, on the ceiling of an automobile body, because the first and second connector bodies are fitted to each other not by pushing the unit side connector upwardly directly from below the wait connector, but by first inserting the first guide flange of the unit side connector into the insertion guide groove for positioning and then sliding the unit side connector in the direction opposite the above-mentioned inserting direction, an operator is not compelled to take the awkward looking-up position for a long period of time and can do the connecting operation in a relatively comfortable position. Thus, an. undue external force is unlikely to be applied, leading to an easy connecting operation even with multipolar connectors.

Preferably, the connector device further comprises a wiring harness having the wait connector attached at one end thereof.

Preferably, the connector device further comprises a harness holding clamp attaced to the wiring harness at a position spaced from the wait connector.

Preferably, the connector device further comprises a molded ceiling to be installed at a ceiling section of an automobile body and having connector-locking and clamplocking throughholes inside which the wait connector and the harness holding clamp are respectively preliminarily locked before the molded ceiling, the wait connector and the harness holding clamp are rigidly fixed at the ceiling section of the automobile body.

Preferably, the connector device further comprises a second clamp attached to the wiring harness at a position closer to the other end of the wiring harness, the second clamp preliminarily locking the wiring harness to an edge of the molded ceiling.

The above and other objects, features and advantages of this invention will become apparent from the following description and the appended claims, taken in conjunction with the accompanying drawings in which like parts or elements are denoted by like reference characters.

BRIEF DESCRIPTION OF THE DRAWINGS

FIGS. 12A to 12D are enlarged views of a harness locking clamp in FIG. 1, of which FIG. 12A is its perspective view, FIG. 12B is its side view, and FIGS. 12C and 12D are explanatory views showing the clamp in use;

FIGS. 13A to 13D are enlarged views of another embodiment of a harness locking clamp, of which FIG. 13A is its perspective view, FIG. 13B is its side view, and FIGS. 13C and 13D are explanatory views showing the clamp in use;

FIGS. 14A to 14D are enlarged views of yet another embodiment of a harness locking clamp, of which FIG. 14A is its perspective view, FIG. 14B is its side view, and FIGS. 14C and 14D are explanatory views showing the clamp in use;

DESCRIPTION OF THE PREFERRED EMBODIMENTS

Embodiments of this invention will now be described with reference to the attached drawings.

Figure 1:
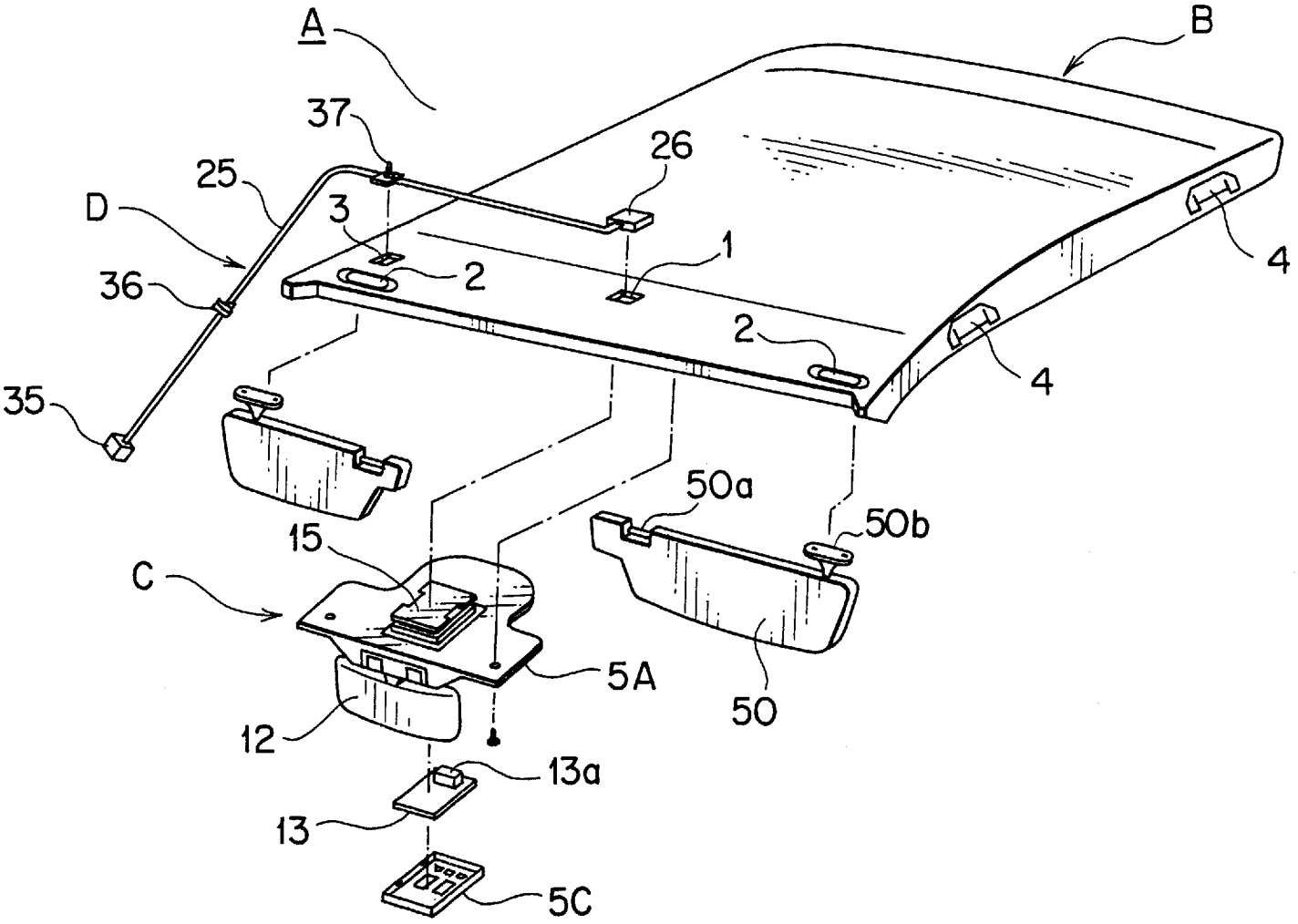
FIG. 1 is an exploded perspective view of an automotive roof module to which a connector device of this invention has been applied.

FIG. 1 is an exploded perspective view of an automotive roof module A to which a connector device of this invention has been applied.

The roof module A consists of a molded ceiling B to be fitted to an automobile ceiling section, a function aggregation unit C to be mounted at the front, driver seat side of the ceiling B, and a roof wiring harness D. Concurrently with its assembly, the function aggregated unit C has a connector 15 thereof (unit side connector) electrically connected to a wait connector 26 on the side of the roof wiring harness D.

The molded ceiling B is molded of synthetic resin material to have a shape which complies with the shape of the automobile ceiling. The molded ceiling B has a connector locking window 1 at a front, central portion thereof, sunvisor mounting throughholes 2 at opposite sides, and a clamp locking window 3 at a front corner. The connector locking window 1 and the clamp locking window 3 constitute locking means for the roof wiring harness D. The molded ceiling B is also provided on left and right opposite end surfaces with mounting grooves 4 for assist grips. Inside the connector locking window 1 and the clamp locking window 3 are respectively locked the wait connector 26 of the roof wiring harness D and a later-described harness holding clamp 37.

Figure 2:
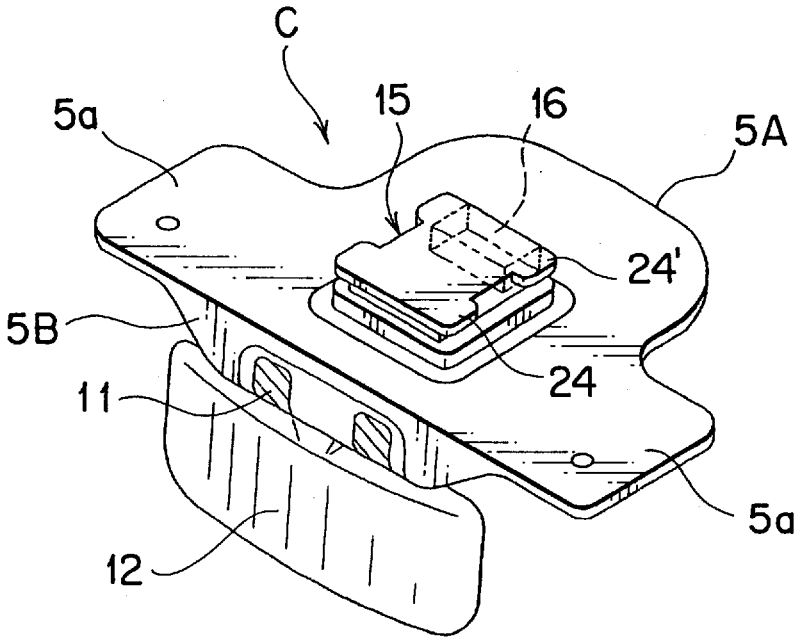
FIG. 2 is an enlarged perspective view of a function aggregated unit in FIG. 1.
Figure 3:
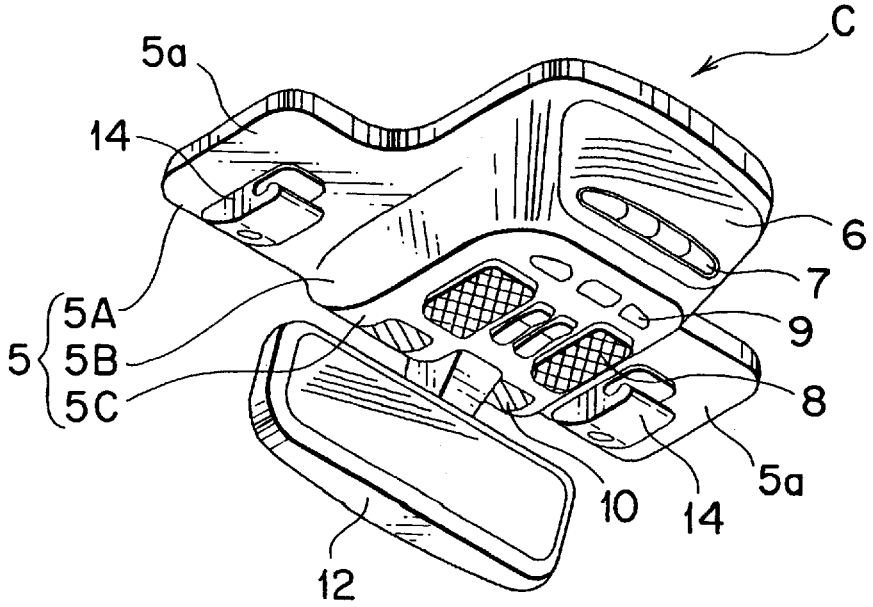
FIG. 3 is a perspective view of the function aggregated unit of FIG. 2, viewed from its underside.

The function aggregated unit C, as best shown in FIGS. 2 and 3, consists of a unit case 5 of synthetic resin material and various functional components 6 to 12 mounted thereon.

The unit case 5 consists of a top plate 5A, a main body 5B at a center on the underside of the top plate, and an under cover 5C. The case main body 5B has at a side opposed to a driver seat an information indicator 6 and its indication selection switches 7, at the underside a map lamp 8 and its switches 9, and at the front of the underside sensors 10 and antennas 11. The case main body 5B also has an electric inside mirror 12 rotatably depending at a front, central portion thereof and a control substrate 13 accommodated thereinside.

The sensors 10 detect amounts of sunlight, smoke and the like inside the cabin and indicate these amounts on the information indicator 6 through the operation of the indication selection switches 7. The antennas 11 are used as a GPS (global positioning system) receiver for a radio and car navigation. The control substrate 13 includes a printed circuit plate incorporating a micon (ECU) and a connector 13a connected to its internal circuit, and processes signals from the switches 7, 9, sensors 10 and the like to control the various functional components.

The top plate 5A has wing portions 5a extended on left and right sides of the case main body 5B, and sun visor holders 14 are integrally formed on the undersides of the wing portions. The top plate 5A also has the unit side connector 15 at a center on its upper surface.

Figure 4:
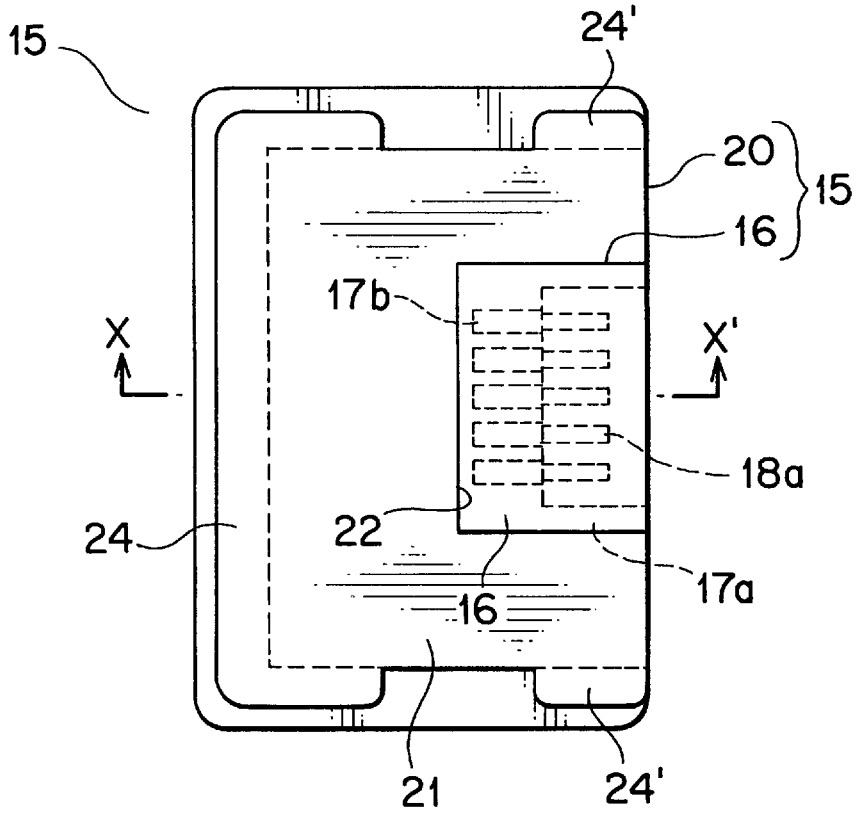
FIG. 4 is a plan view of a unit side connector in FIG. 1.
Figure 5:
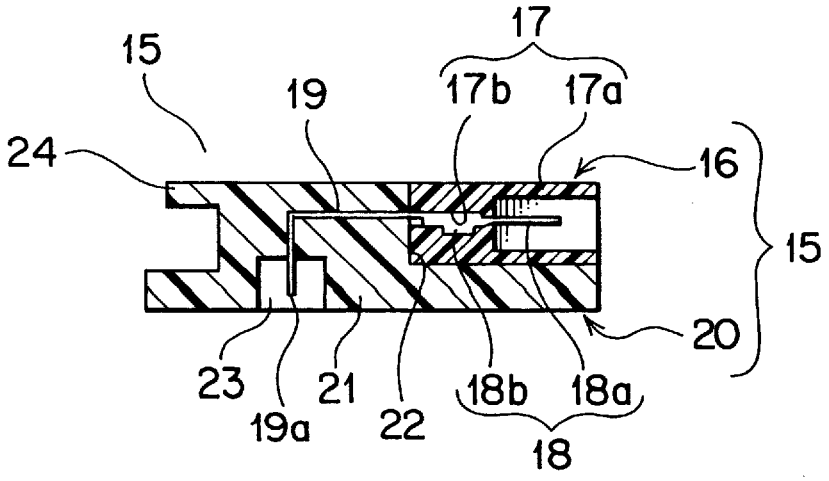
FIG. 5 is a sectional view taken along the line X—X' of FIG. 4.

As shown in FIGS. 4 and 5, the unit side connector 15 consists of a first connector body 16 and its support 20. The connector body 16 consists of an insulating housing 17 having a hood 17*a* at a front, fitting side thereof and a row of terminal accommodating chambers formed therein, and male terminals 18, each having a front half, tab portion 18a located inside the hood 17*a* and a rear half, lead connecting portion 18*b* locked inside a related terminal accommodating chamber 17*b*. An L-shaped pin jack 19 is at one end connected to the lead connecting portion 18*b* and at the other end extends into a connector receiver 23 formed in the underside of the connector support 20 to be fitted to and electrically connected to the connector 13*a* of the above-mentioned control substrate 13.

The connector support 20 consists of a block body 21 of a size sufficiently larger than the connector body 16, a recess 22 formed in an upper surface of the block body, at a center at the side opposed to the driver seat where the connector body 16 is fitted, and the above-mentioned connector receiver 23 formed in the underside at a rearward position of the block body. The block body 21 has a first guide flange 24 provided projecting outwardly on rear and left and right end surfaces at a rear half of the block body, and second guide flanges 24' provided projecting outwardly on left and right end surfaces at a front half of the block body.

Reverting to FIG. 1, the roof wiring harness D consists of a flat cable 25, which has the wait connector 26 at one end, another connector 35 at the other end, and a clamp 36 and the harness holding clamp 37 at intermediate portions thereof, the another connector 35 being to be arranged on the side of a pillar E as later-described and connector-connected to a not-shown instrument panel wiring harness.

The roof wiring harness D is preliminarily fastened to the molded ceiling B until the molded ceiling is installed on the automobile ceiling section, and the clamp 36 and the holding clamp 37 serve for that purpose.

Figure 6:
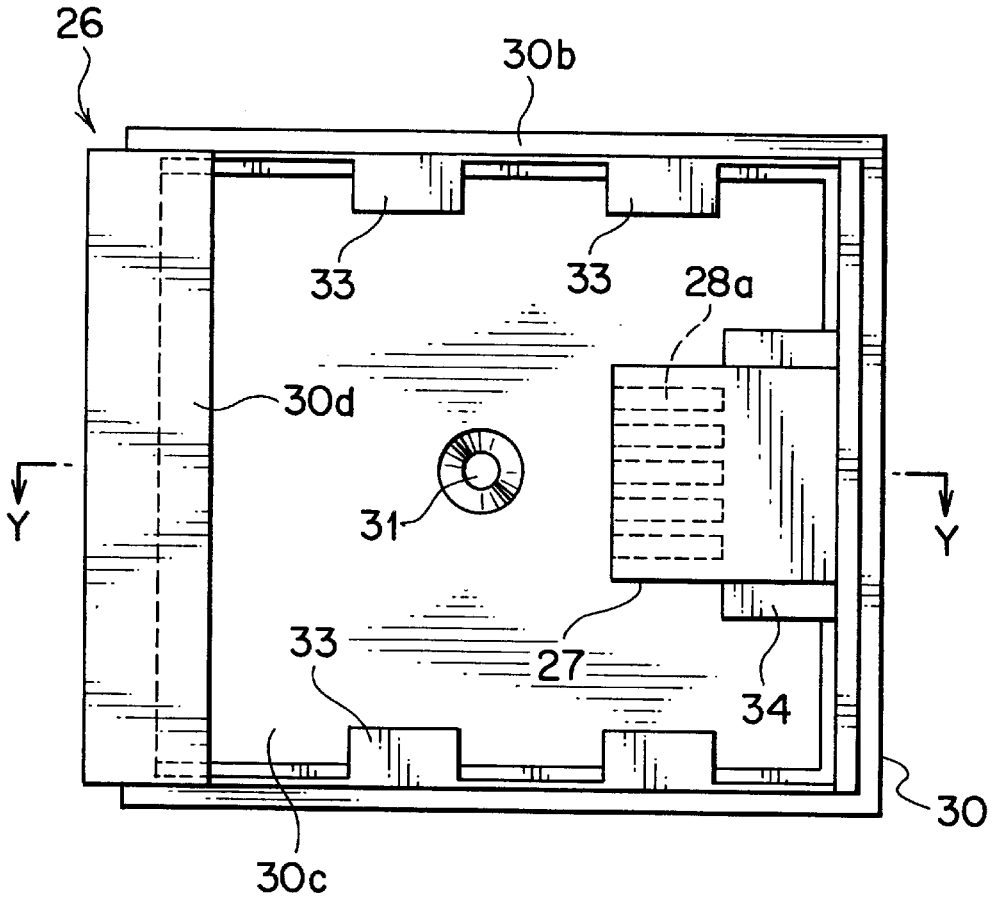
FIG. 6 is a plan view of a wait connector attached to a roof wiring harness in FIG. 1.
Figure 7:
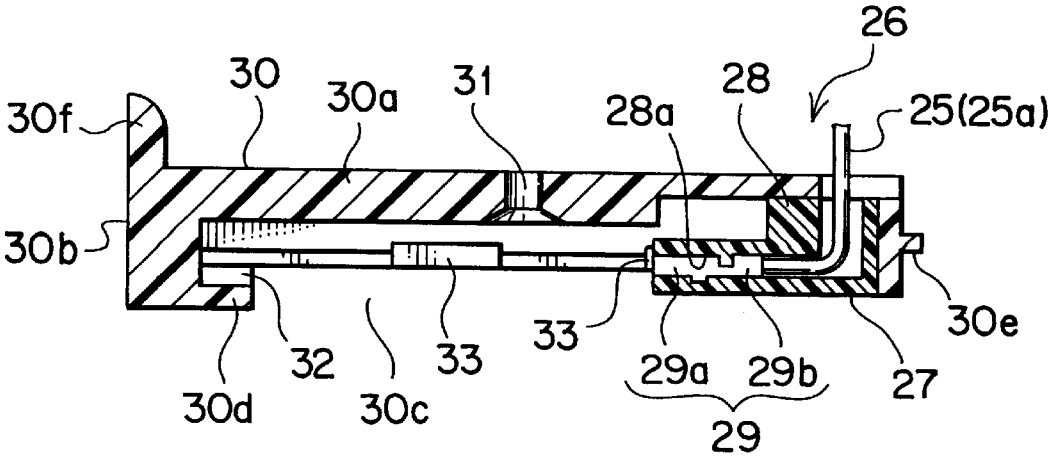
FIG. 7 is a sectional view taken along the line Y—Y' of FIG. 6.

The wait connector 26, as shown in FIGS. 6 and 7, consists of a second connector body 27 and its cover 30. The connector body 27 is made up of an insulating housing 28 with a row of terminal accommodating chambers 28*a* formed therein and female terminals 29 locked inside the terminal accommodating chambers, each female terminal 29 having an electric contact portion 29*a* at the front and a wire connecting portion 29*b* at the rear to which is connected a wire 25*a* of the flat cable 25.

The connector cover 30 is a box-shaped case which consists of a ceiling wall 30*a* and peripheral walls 30*b* therearound and opens downwardly to provide an opening 30*c*, and which is sufficiently larger in size than the connector body 27. The ceiling wall 30*a* is formed with a screw hole 31. The peripheral wall 30*b* at the front is formed with an inwardly directed support edge 30*d* to provide an insertion guide groove 32 between it and the ceiling wall 30*a*, and each lateral peripheral wall 30*b* is on its inner wall surface formed with longitudinally spaced support pieces 33. The support pieces 33 are positioned at an intermediate height between the support edge 30*d* and the ceiling wall 30*a* . The internal distance between the lateral, left and right peripheral walls 30*b* is set substantially equal to the external distance between the guide flanges 24 (24') of the unit side connector 15.

Figure 15:
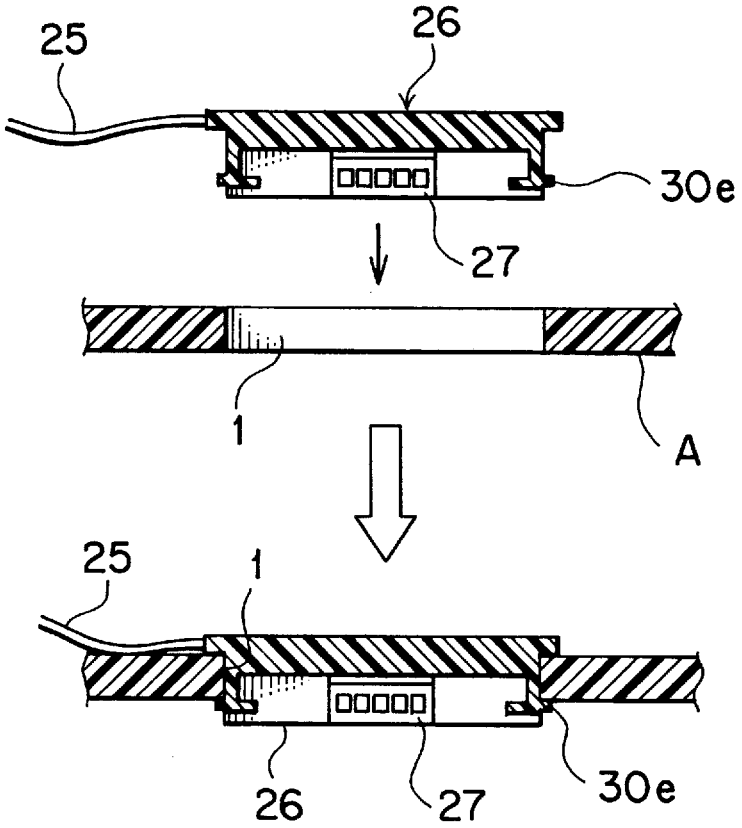
FIG. 15 is an explanatory view of a structure for preliminarily locking together the wait connector and a molded ceiling in FIG. 1.

The peripheral walls 30*b*, as best shown in FIG. 15, are on their outer surfaces further provided with lock ribs 30*e* that engage edges of the connector locking window 1 to lock the wait connector. Further, the peripheral wall 30*b* at the rear is on its inner wall surface provided with a mount 34 where the connector body 27 is fitted and fixed. With the connector body 27 fitted and fixed in the mount 34, the unit side connector 15 can be accommodated in the opening 30 from therebelow. Preferably, the ceiling wall 30*a* is on its upper surface at the front end provided with a rotation prevention piece 30*f* which also serves as a positioning means.

Figure 12A:
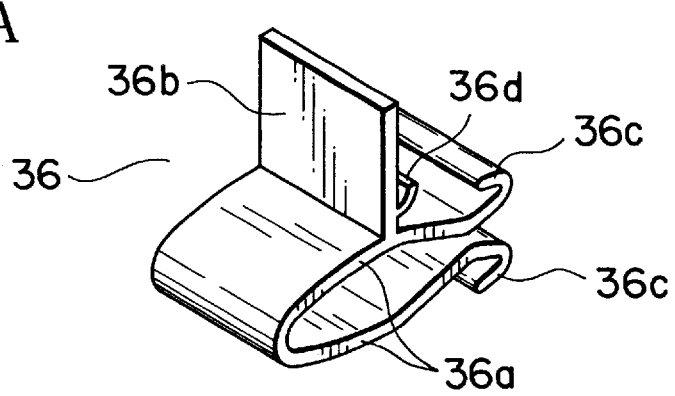

The clamp 36 forms one of the preliminary locking means for preliminarily locking the roof wiring harness D to the molded ceiling B. The clamp 36, as shown in FIG. 12A, is made up of a U-shaped pair of resilient holding arms 36*a*, 36*a* molded of synthetic resin material, a harness securing piece 36*b* provided upright on the outer surface of one of the holding arms, claw pieces 36*c* bent back outwardly at the front ends of the holding arms 36*a*, 36*a*, and a cable stopping strip 36*d* provided at the rising base of the harness securing piece 36*b* .

Figure 12B:
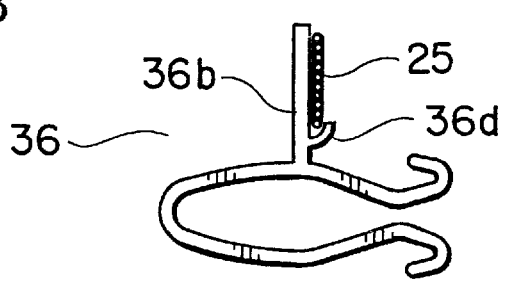
Figure 12C:
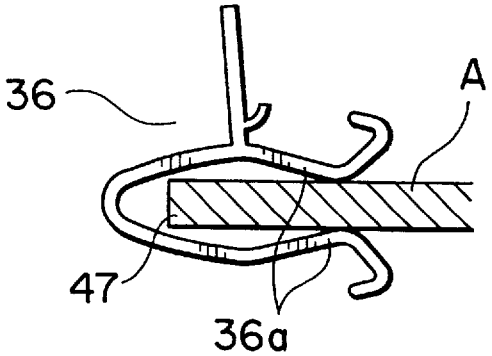
Figure 12D:
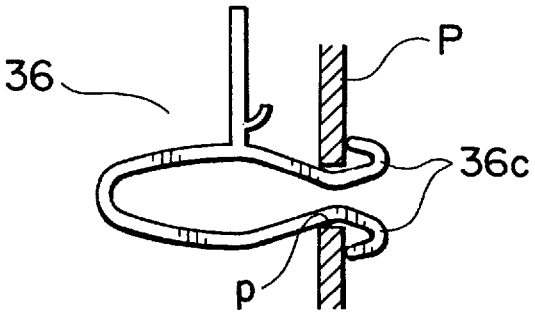
Figure 13A:
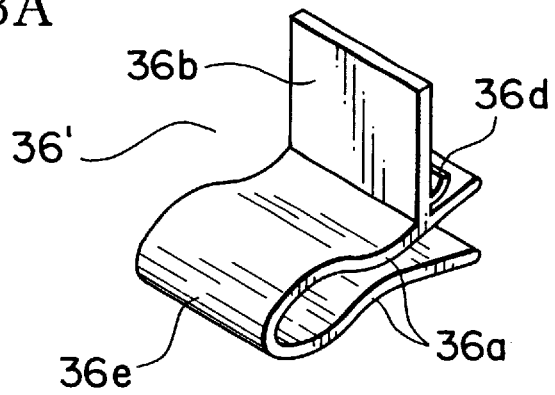
Figure 13B:
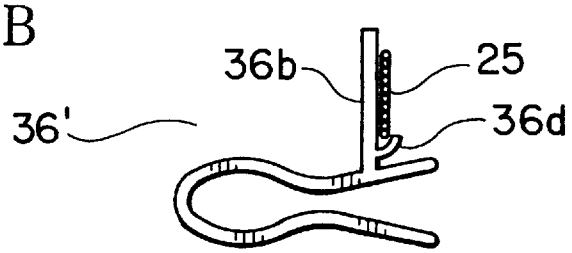
Figure 13C:
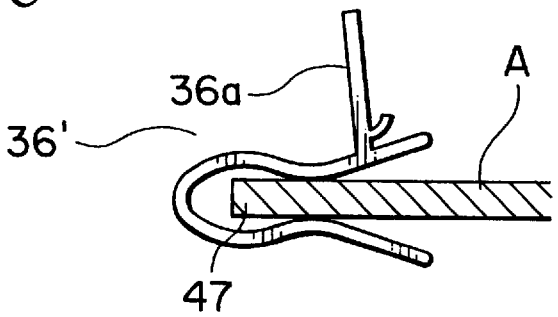
Figure 13D:
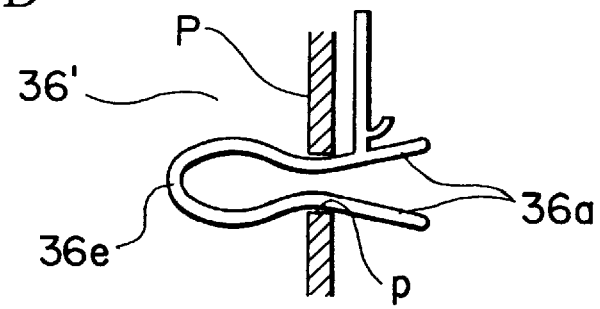
Figure 14A:
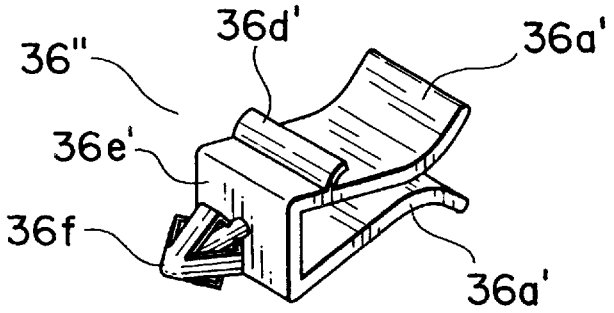
Figure 14B:
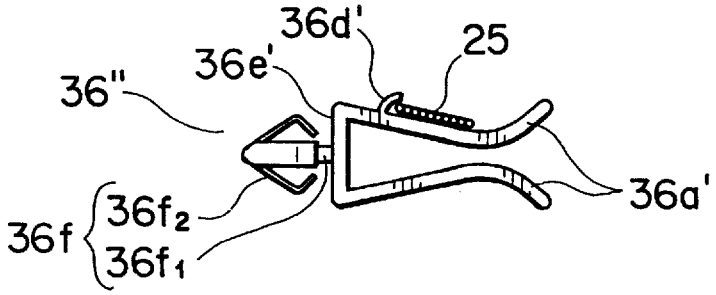
Figure 14C:
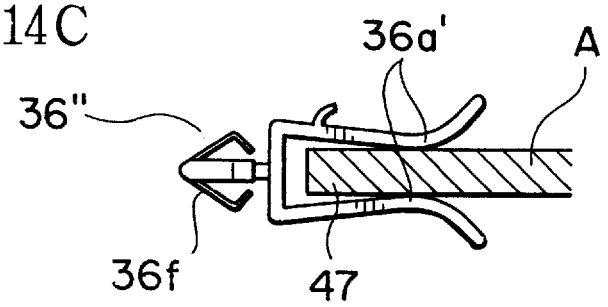
Figure 14D:
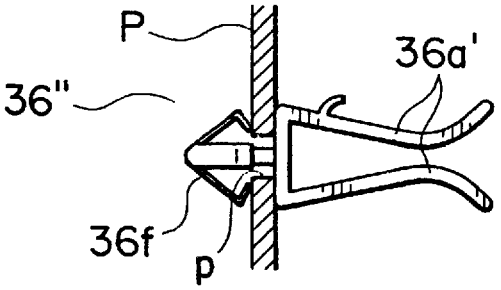

In use of this clamp 36, as shown in FIG. 12B, the flat cable 25 is secured through a tape or glue to the harness securing piece 36*b* . The strip 36*d* facilitates the positioning and securing operation of the flat cable 25. As shown in FIG. 12C, the pair of resilient holding arms 36*a*, 36*a* hold therebetween a side edge 47 (FIG. 17) to preliminarily lock the flat cable 25 (or roof wiring harness D). The claw pieces 36*c* at the end of the resilient holding arms 36*a*, as shown in FIG. 12D, may be inserted into a hole p as in an automobile body panel (or bracket) P to secure the flat cable 25 to the panel P.

FIGS. 13A to 13D show another embodiment of a clamp. In other words, the clamp 36' does not have claw pieces 36*c*, 36*c* at the end of the pair of resilient holding pieces 36*a*, 36*a* and, instead, a connecting portion 36*e* thereof that connects the resilient holding arms 36*a*, 36*a* is provided in a rounded shape.

In this case, the flat cable 25 is secured to the harness securing piece 36*b* (FIG. 13B), and the resilient holding arms 36*a*, 36*a* hold therebetween the side edge 47 of the molded ceiling B (FIG. 13C) as in the preceding example. The connecting portion 36*e*, however, can be inserted into the hole p (FIG. 13D) to preliminarily lock the clamp 36' to the panel P and pulled out if desired because there are provided no claw pieces 36*c*, making the clamp 36' suitable for preliminary locking.

FIGS. 14A to 14D show yet another embodiment of a clamp. In other words, the clamp 36" consists of a pair of resilient holding arms 36*a* ', 36*a* ', a connecting portion 36*e* 'that connects the holding arms 36*a* ', 36*a* ', provided in a flat plate shape, a clip 36*f* provided projecting on the flat connecting portion 36*e* ', which consists of a support 36*f*1 and a plurality of wings 36*f*2, and a cable stopping strip 36*d* provided on the outer surface of one of the resilient holding arms 36*a* ', 36*a* '.

In this case, since the resilient holding arms 36*a* ' for preliminarily locking the clamp 36" to the side edge 47 of the molded ceiling B and the clip 36*f* for engagement in the panel hole p are separately provided with their respective functions, a greater variety of design changes will be possible. The flat cable 25 is secured onto one of the resilient holding arms 36*a* ' as in the preceding examples.

Figure 16:
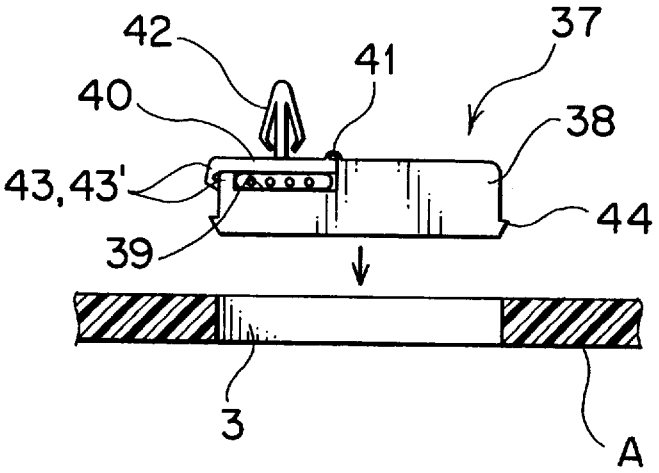
FIG. 16 is an explanatory view of a structure for preliminarily locking together a harness holding clamp and the molded ceiling in FIG. 1.

The harness holding clamp 37 forms another locking means and, as shown in FIG. 16, consists of a base plate 38 of synthetic resin material, a cable receiving groove 39 formed in the upper surface at one side of the base plate, a groove cover 40 provided with a hinge 41 to be opened and closed, and a clip 42 provided projecting on the groove cover 40, which is of the same structure as the clip 36*f* of the clamp 36" as previously described. Denoted 43, 43' are locking means that cooperate with each other to lock the groove cover 40 to the base plate 38. The base plate 38 has on its lower outer surfaces locking ribs 44 for locking engagement with edges of the clamp locking window 3.

In the construction as mentioned above, the unit side connector 15 of the function aggregated unit C and the wait connector 26 of the roof wiring harness D are fitted and connected to each other as follows.

Figure 8:
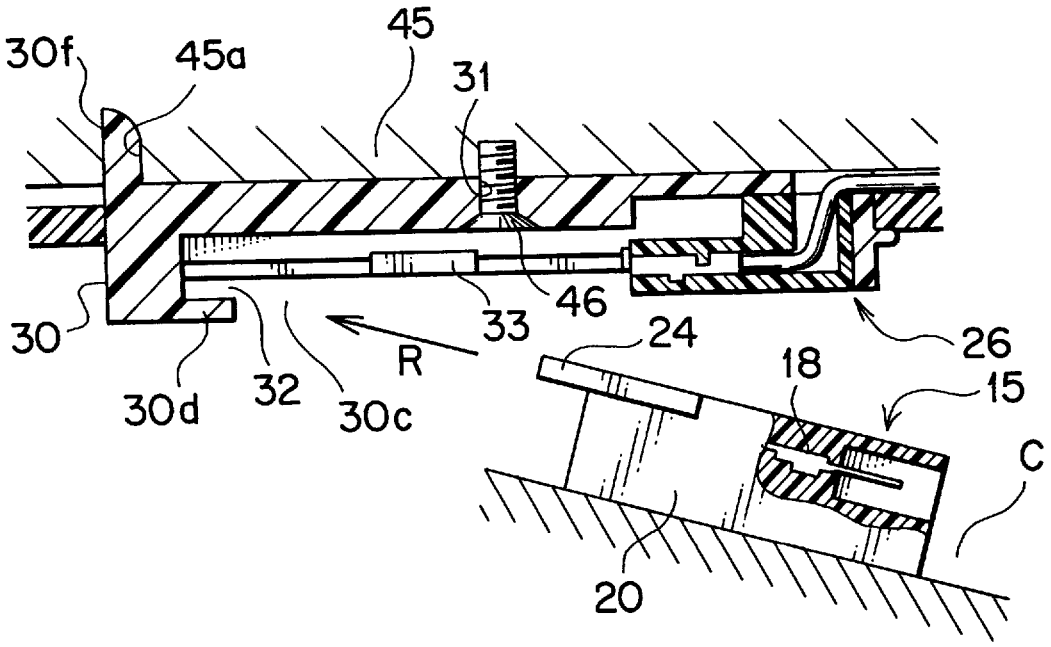
FIG. 8 is a sectional view showing the start state for connecting the wait connector and the unit side connector.

First, as shown in FIG. 8, the wait connector 26 is fixed to the bracket 45 at the automobile ceiling section with a screw 46 threaded into the screw hole 31. In this instance, due to the rotation prevention piece 30*f* on the connector cover 30 inserted into the hole 45*a* on the bracket 45, the wait connector 26 can be easily positioned and securely fixed in place by the single screw 46.

Figure 9:
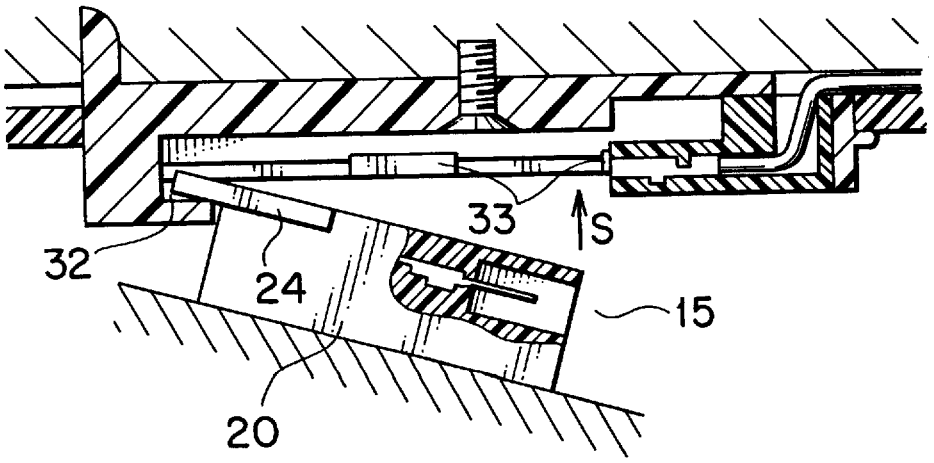
FIG. 9 is a sectional view showing the step following FIG. 8.

In this state, the unit side connector 15 is inserted in an inclined posture as shown by an arrow R into the opening 30*c* from below the connector cover 30, so that the front end of the first guide flange 24 of the connector support 20 is positioned inside the insertion guide groove 32 as shown in FIG. 9, and then the unit side connector 15 is at the other end pushed upwardly as shown by an arrow S. Thus, as shown in FIG. 10, the unit side connector 15 is put in close contact with the inner surface of the ceiling wall 30*a* of the wait connector 26 so that the first and second connector bodies 16 and 27 are opposed to each other on the same axis.

Because the first and second guide flanges 24, 24' of the unit side connector 15 are longitudinally alternated with the support pieces 33 on the side of the wait connector 26, they do not interfere with each other during the rotating and pushing up operation of the unit side connector 15. The guide flanges 24, 24' are positioned at an intermediate height between the ceiling wall 30*a* and the support pieces 33 of the connector cover 30.

Figure 10:
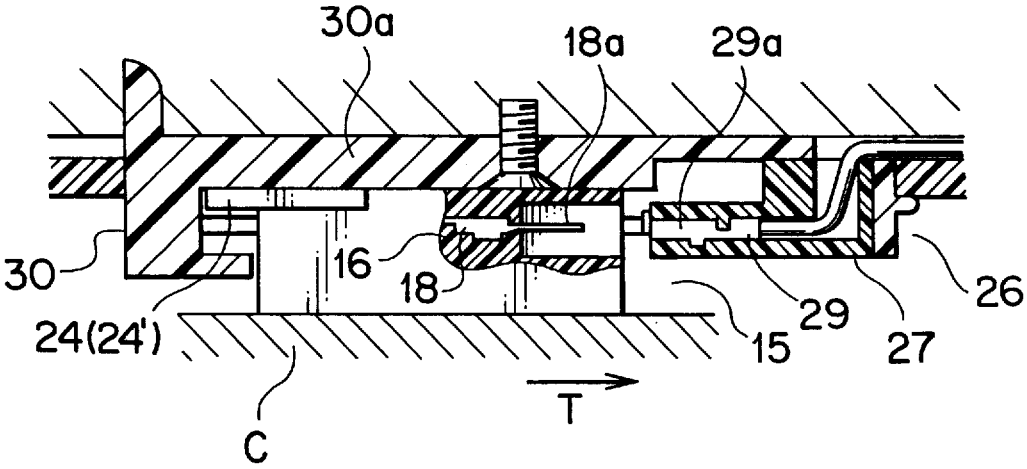
FIG. 10 is a sectional view showing the step following FIG. 9.

The unit side connector 15 is then moved in the direction of an arrow T in FIG. 10, so that the connector body 27 advances into the hood 17*a* of the connector body 16, and that the tab portion 18*a* of the male terminal 18 is inserted into the female terminal electric contact portion 29*a* to connect the terminals 18 and 19. Concurrently, the first and second guide flanges 24, 24' come to be supported on the longitudinally spaced support pieces 33, 33.

Figure 11:
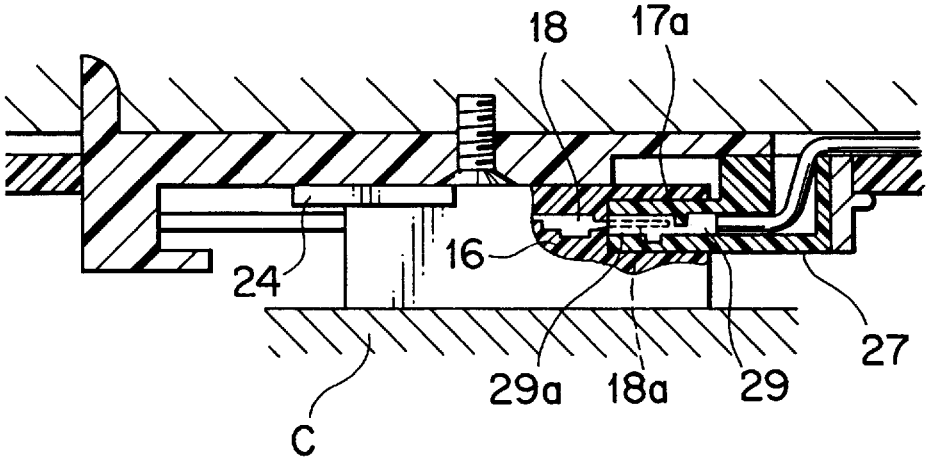
FIG. 11 is a sectional view showing the state where the connection is completed.

To detach the unit side connector 15 and the wait connector 26, the procedure as described above will be followed reversely (from FIG. 11 to FIG. 8).

In this instance, because the internal dimension between the left and right peripheral walls 30*b* of the connector cover 30 is set substantially equal to the external dimension between the left and right guide flanges 24 (24') of the unit side connector 15, the unit side connector 15 is smoothly guided without plays during its movement inside the connector cover 30.

The assembling procedure of the automotive roof module A will now be described with reference to FIGS. 17 to 20.

Figure 17:
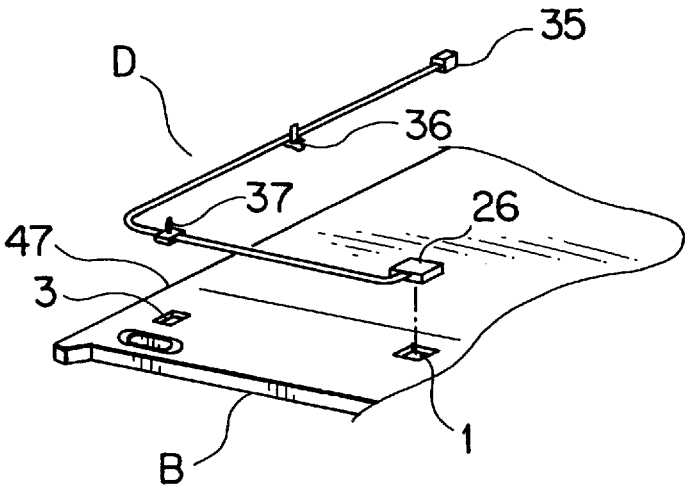
FIG. 17 is an explanatory view showing the automotive roof module to be assembled to an automobile body.

First, the roof wiring harness D is preliminarily locked to the molded ceiling B as shown in FIG. 17. In other words, the wait connector 26 and the harness holding clamp 37 of the roof wiring harness D are respectively inserted into the connector locking window 1 and the clamp locking window 3 in the molded ceiling B and preliminarily locked there by the locking ribs 30*e* and 44 as described in conjunction with FIGS. 15 and 16.

Further, the pair of resilient holding arms 36*a*, 36*a* of the clamp 36 at a position of the roof wiring harness D closer to the instrument panel wiring harness connecting connector 35 hold therebetween the side edge 47 of the molded ceiling B in the manner as shown in FIG. 12C to have the wiring harness D preliminarily locked along the side edge 47. To facilitate the preliminary locking of the wiring harness D, a magic tape or adhesive tape may be in advance provided on the wiring harness or the molded ceiling B.

Figure 18:
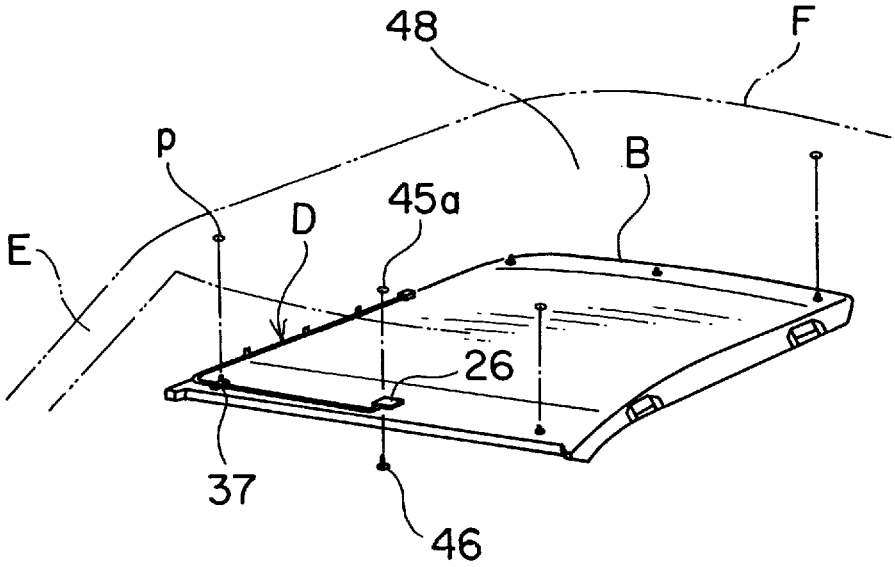
FIG. 18 is an explanatory view of the step following FIG. 17.

Next, as shown in FIG. 18, the molded ceiling B with the roof wiring harness D preliminarily locked thereto is put in place on the ceiling section 48 of an automobile body F and fixed there with not-shown clamps and screws .

Figure 19:
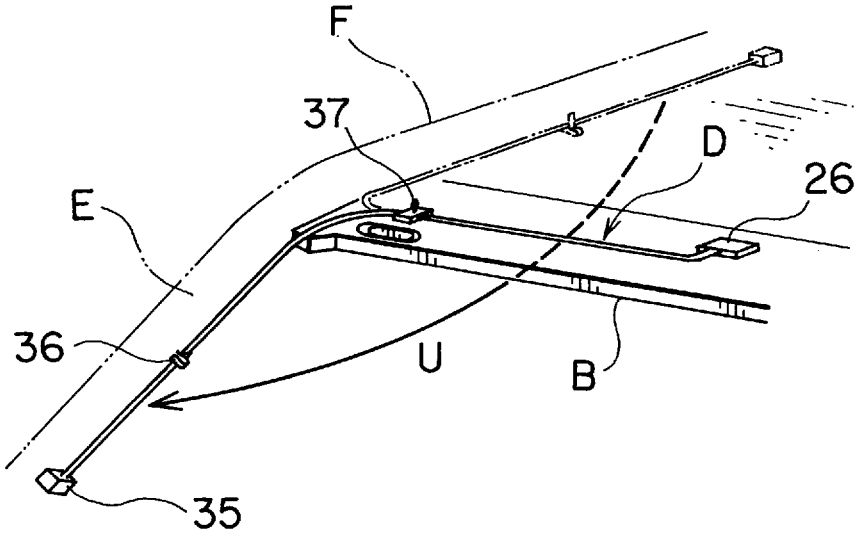
FIG. 19 is an explanatory view of the step following At FIG. 18.

At the ceiling section 48, there are provided in advance the bracket hole 45a as described in conjunction with FIG. 8 and the panel hole p as in FIG. 12D. Thus, on assembling the molded ceiling B with the not-shown clamps and screws, the rotation prevention piece 30*f* of the wait connector 26 is positioned into the bracket hole 45*a* and the clip 42 of the harness holding clamp 37 is inserted into the panel hole p to be locked there. Thereafter, the fixing of the wait connector 26 with the screw 46 is effected as shown in FIG. 8 to complete the assembly of the molded ceiling B.Then, as shown in FIG. 19, that part of the roof wiring harness D which is locked preliminarily along the side edge of the molded ceiling B is removed therefrom and bent forwardly as indicated by an arrow U to be arranged on the pillar E side, followed by connector-connecting its connector 35 to the not-shown instrument panel wiring harness.

Figure 20:
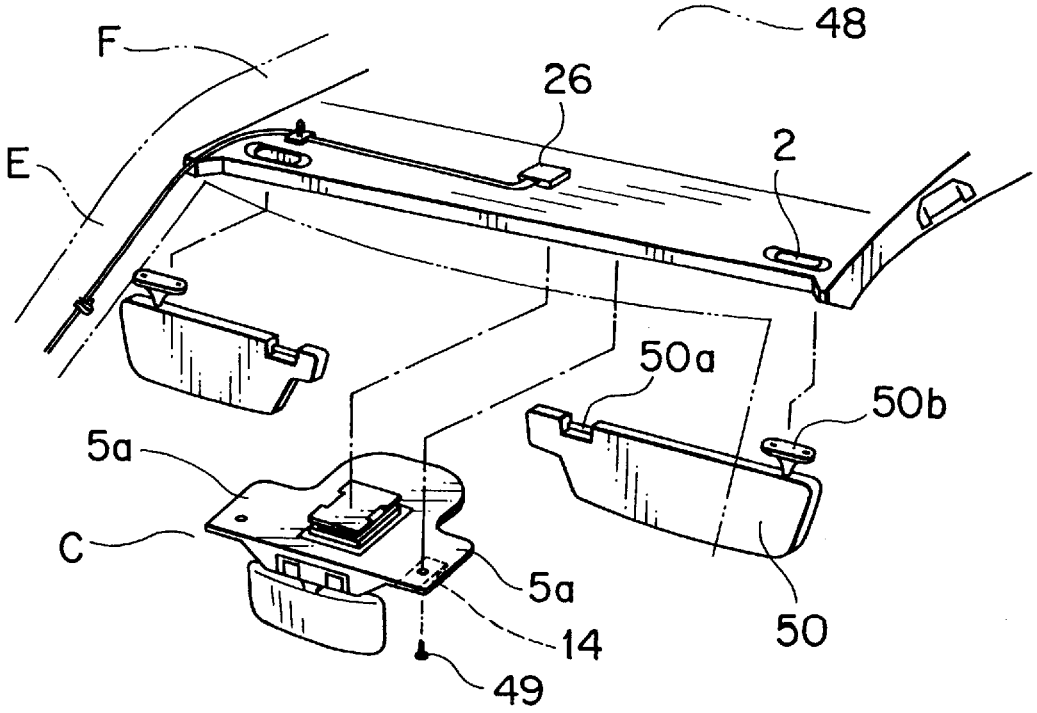
FIG. 20 is an explanatory view of the final step following FIG. 19.

Thereafter, at the front, driver seat side of the molded ceiling B, the connector 15 of the function aggregated unit C is fitted and connected to the wait connector 26 after the manner as described in conjunction with FIGS. 8 to 11, followed by, as shown in FIG. 20, fixing the wing portions 5*a*at opposite sides of the function aggregated unit C to the molded ceiling B with screws 49.

Finally, hook pins 50*a* at one side of the sun visors 50 are engaged with sun visor holders 14 on the underside of the wing portions 5*a*, and fixtures 50*b* at the other side of the sun visors are passed through holes 2 and fixed to the ceiling section 48 of the automobile body F with screws to complete the assembly of the automotive roof module A.

When the not-shown clamps and screws are removed and the molded ceiling B is detached for maintenance or the like, because the wait connector 26 remains fixed to the ceiling section 48 with the screw 46 and the harness holding clamp 37 remains locked in the panel hole p due to the clip 42. Thus, the roof wiring harness D remains as it is on the automobile body F side, making it possible to detach only the molded ceiling B and facilitating checking and maintenance operations.

The roof wiring harness D, although shown in the above examples to consist of the flat cable 25, is not limited to one of a flat shape and may be in the form of an ordinary bundle of wires. Further, an FFC may be used for the flat cable 25.

Figure 21:
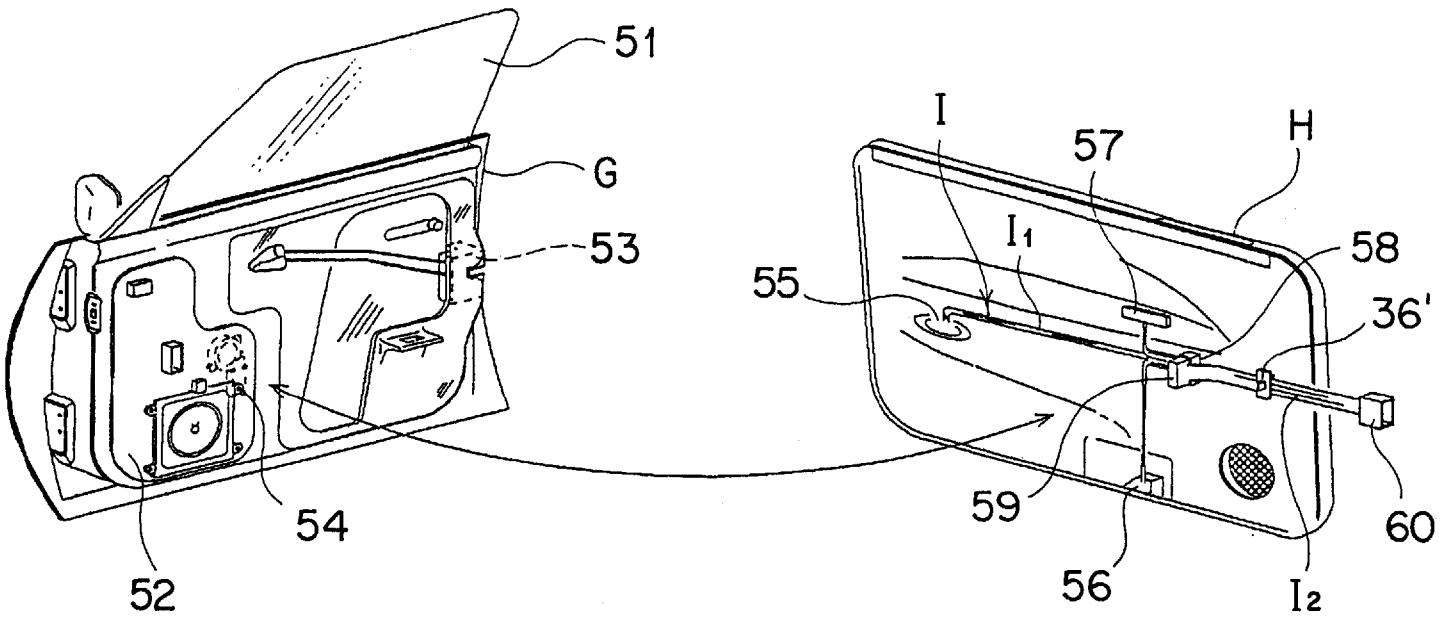
FIG. 21 is an explanatory view of another application of this invention directed to assembling a door wiring harness.
Figure 22:
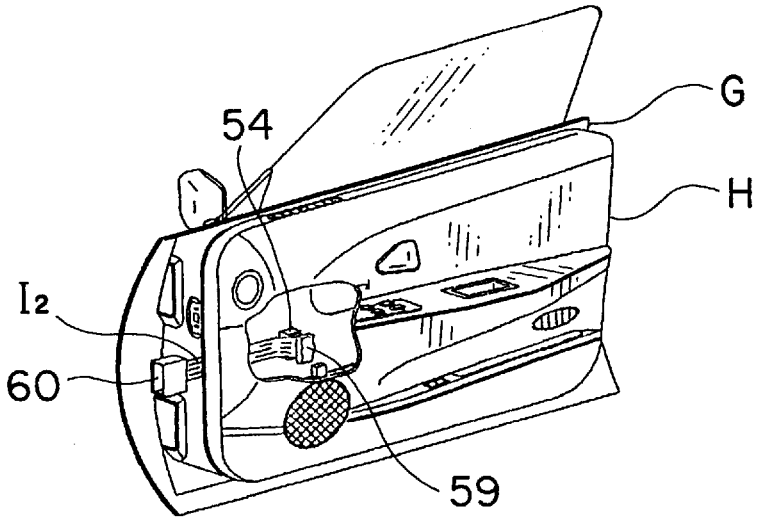
FIG. 22 is an explanatory view of the state where the assembly of FIG. 21 is completed.
Figure 23:
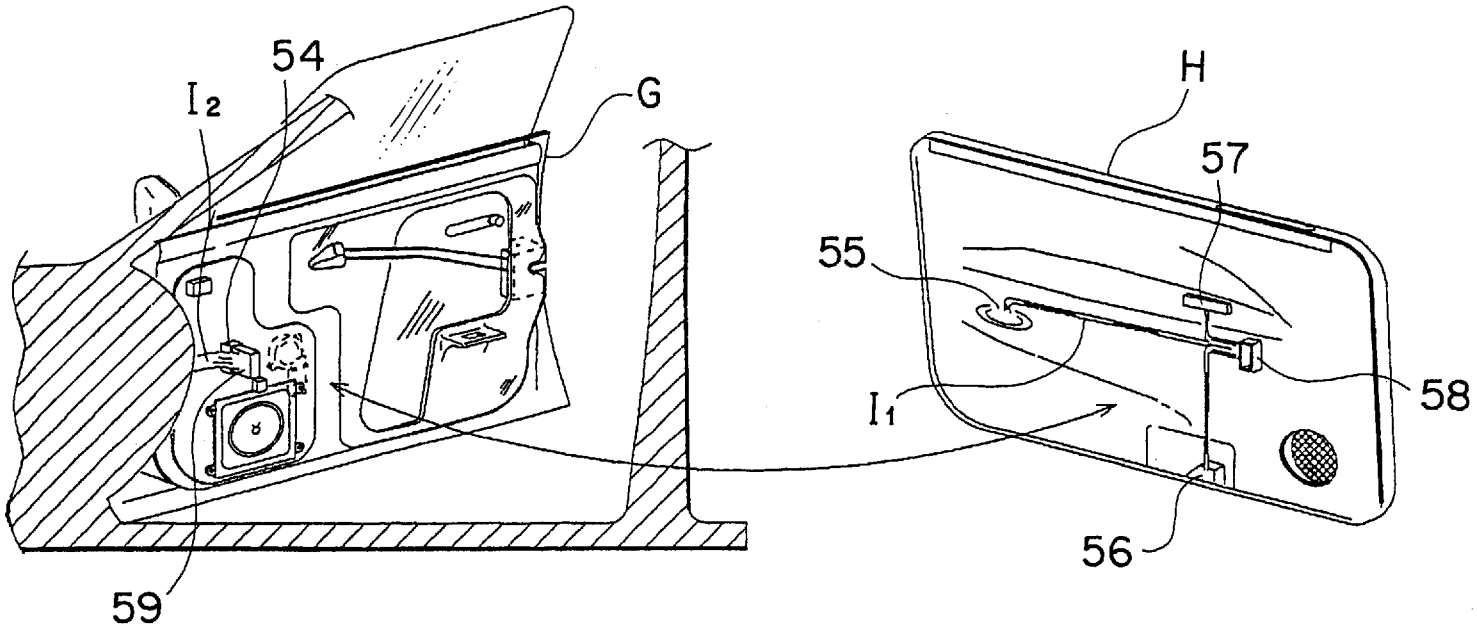
FIG. 23 is an explanatory view showing the state where the door wiring harness of FIG. 21 is separated at the time of maintenance.
Figure 24:
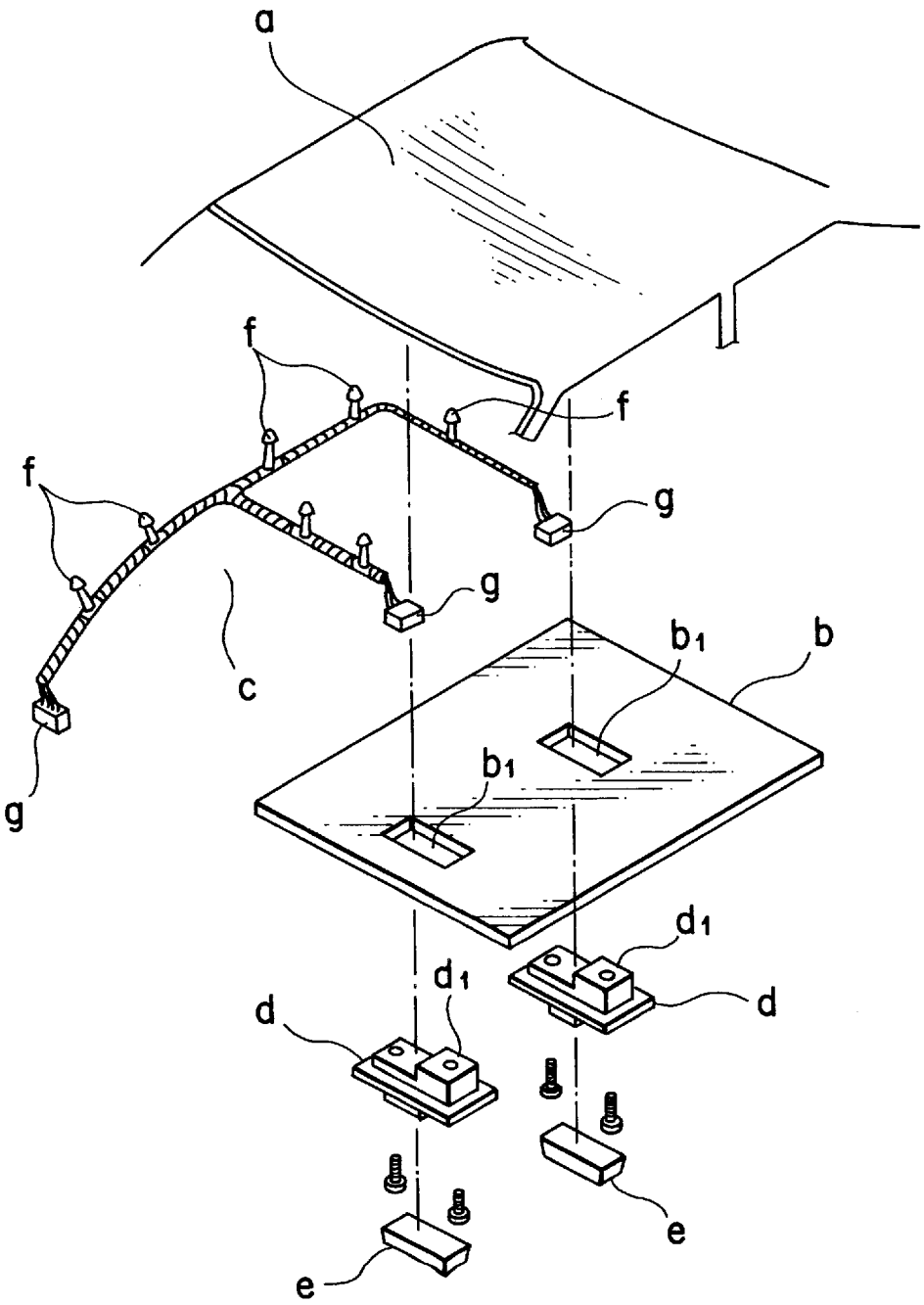
FIG. 24 PRIOR ART
FIG. 24 is an exploded perspective view of an example of a conventional roof module.
Figure 25:
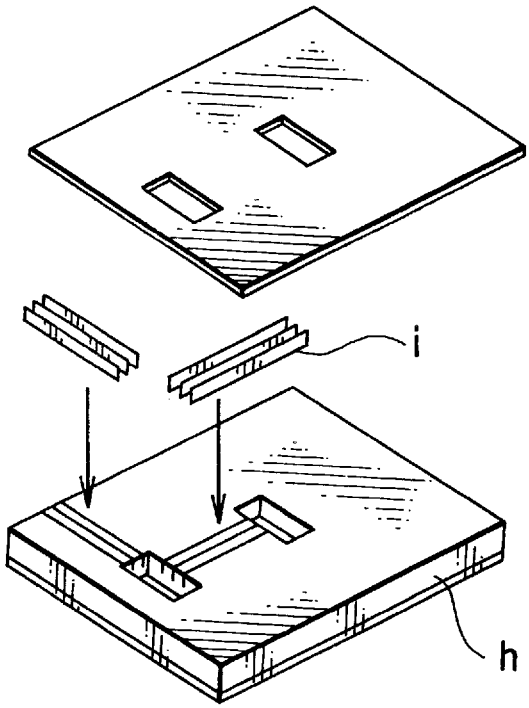
F I G. 25 PRIOR ART
FIG. 25 is an exploded perspective view of another example of a conventional roof module.

FIGS. 21 to 23 show an example where the mechanism for preliminarily locking the roof wiring harness D to the molded ceiling B has been applied to the preliminary locking of a door wiring harness.

In FIG. 21, a door frame G is inside thereof provided with electric equipment such as a regulator unit 52 for a power window 51, door lock device 53 and the like, the regulator unit 52 having an aggregated connector 54 for the electric equipment inside the door frame G. Denoted H is a trim board to be assembled to the cabin side of the door frame G, which trim board has arranged thereon a flat-shaped door wiring harness I as well as electric equipment such as a courtesy lamp 55, foot lamp 56 and option switch 57.

The door wiring harness I consists of a stationary portion I1 fastened to the trim board H and a separatable harness connecting portion I2 which connects to a cowl side wiring harness (not shown). The harness connecting portion I2 has at one end a double-faced connector 59 via one face of which the connecting portion I2 is connector-connected to the stationary portion I1 and at the other end a connector 60 for connection to the cowl side wiring harness. The harness connecting portion I2 also has at an intermediate portion thereof the clamp 36' as described hereinabove which is engaged in a panel hole p in the trim board H after the manner shown in FIG. 13D to preliminarily lock the the connecting portion I2 thereto.

With the construction as described above, when the trim board H is assembled as shown in FIG. 22 with screws or the like, the other face of the double-faced connector 59 of the harness connecting portion I2 is fitted and connected to the aggregated connector 54 on the door frame G side.

If the trim board H is removed as shown in FIG. 23 for maintenance or the like, the harness connecting portion 12, which has been preliminarily locked by means of the clamp 36', remains on the door frame G side, while the stationary portion I1 is separated together with the trim board H. In other words, because the fitting force of the double-faced connector 59 with the aggregated connector 54 and the fitting force of the connector 60 are each greater than the preliminary locking force of the clamp 36', the harness connecting portion I2 is separated from the trim board H, leading to an easy checking and maintenance of the door frame G and the trim board H as in the case in FIG. 20.

Having now fully described the invention, it will be apparent to one of ordinary skill in the art that many changes and modifications can be made thereto without departing from the spirit and scope of the invention as set forth herein.

What is claimed is:

1. A connector device comprising:

a unit side connector provided on a surface of an electric equipment unit, said unit side connector comprising a connector support, a first connector body accommodating at least one first terminal therein and provided at one end of said connector support, and a first guide flange provided projecting on an end surface of the other end of said connector support and second guide flanges provided projecting at lateral end surfaces of said connector support; and a wait connector fastened to a wall surface of an automobile body panel, said wait connector comprising a connector cover, a second connector body accommodating therein at least one mating terminal for said first-terminal and provided at one end of said connector cover, an opening formed at the other end side of said connector cover, adjacent to said second connector body for accommodation therein of said unit side connector, an insertion guide groove formed at one end of said opening at said the other end side of said connector cover, and support pieces provided projecting inwardly at lateral opposte sides of said opening, wherein said unit side connector, after said first guide flange thereof is inserted into said insertion guide groove, is as a whole moved into said opening and pushed against a ceiling wall thereof, and then slid toward said second connector body to cause said first and second connector bodies to be fitted and connected to each other and said second guide flanges to be supported on said support pieces.

2. The connector device according to claim 1, further comprising a wiring harness having said wait connector attached at one end thereof.

3. The connector device according to claim 2, further comprising a harness holding clamp attaced to said wiring harness at a position spaced from said wait connector.

4. The connector device according to claim 3, further comprising a molded ceiling to be installed at a ceiling section of an automobile body and having connector-locking and clamp-locking throughholes inside which said wait connector and said harness holding clamp are respectively preliminarily locked before said molded ceiling, said wait connector and said harness holding clamp are rigidly fixed at said ceiling section of the automobile body.

5. The connector device according to claim 4, further comprising a second clamp attached to said wiring harness at a position closer to the other end of said wiring harness, said second clamp preliminarily locking said wiring harness to an edge of said molded ceiling.

* * * * *